US005730191A

United States Patent [19]

Cooper et al.

[11] Patent Number: 5,730,191

[45] Date of Patent: Mar. 24, 1998

[54] PIN STRAIGHTENING TOOL FOR A MULTI-PIN CONNECTOR

[75] Inventors: Rodney L. Cooper, Wewoka; Randall D. Wakely, Chandler; Darin D. Just, Edmond; Larry E. Goodman, Del City; Dana R. Fricke; Ira M. Bailey, both of Oklahoma City; Issac Varkey, Yukon; John W. Hankins, Wellston; Michael D. Pham, Oklahoma City; William G. Guzanich, Oklahoma City; Bryan DiMambro, Oklahoma City, all of Okla.

[73] Assignee: Seagate Technology, Inc., Scotts Valley, Calif.

[21] Appl. No.: 637,871

[22] Filed: Apr. 25, 1996

[51] Int. Cl.[6] ..... B21F 01/02

[52] U.S. Cl. ..... 140/123; 140/147

[58] Field of Search ..... 140/106, 123, 140/147; 81/177.4; 72/458

[56] References Cited

U.S. PATENT DOCUMENTS

| | | | |
|---|---|---|---|
| 1,276,235 | 8/1918 | Loranger . | |
| 2,577,651 | 12/1951 | Dewey | 81/177.4 |
| 2,971,555 | 2/1961 | Paulson | 140/147 |
| 3,041,649 | 7/1962 | Isenhour . | |
| 3,186,262 | 6/1965 | Parstorfer | 140/123 |
| 3,417,603 | 12/1968 | Loew . | |
| 4,028,812 | 6/1977 | Fieberg . | |
| 4,416,143 | 11/1983 | Fouroux et al. . | |
| 5,203,382 | 4/1993 | Barnhart et al. | 140/147 |
| 5,518,044 | 5/1996 | Ferguson | 140/123 |

*Primary Examiner*—Lowell A. Larson

*Attorney, Agent, or Firm*—Bill D. McCarthy; Edward P. Heller, III; Randall K. McCarthy

[57] ABSTRACT

A pin straightening tool for aligning a pin in a multi-pin connector. The pin straightening tool includes an electrically conductive handle having a beveled end and a hollow recess extending longitudinally into the beveled end. An alignment tip is connected to the end of the handle and used to align the pin. The alignment tip includes a shaft which is inserted into the recess of the beveled end of the handle and a tube which extends longitudinally from the shaft and away from the handle. The tube has a hollow recess having an inner diameter sized for receipt of the pin and the outer diameter of the tube is sized for placement of the tube between adjacent pins in the multi-pin connector. Engagement means is provided between the alignment tip and the handle so that the alignment tip can be engaged and subsequently removed from the handle. A pocket clip is attached to the handle for clipping the pin straightening tool when the pin straightening tool is not in use. A hollow recess within the handle facilitates storage of additional alignment tips for use with different sized pins in different connectors.

5 Claims, 2 Drawing Sheets

PIN STRAIGHTENING TOOL FOR A MULTI-PIN CONNECTOR

BACKGROUND OF THE INVENTION

1. Field of the Invention

This invention relates generally to electrical connectors, and more particularly, but not by way of limitation, to an improved hand tool for straightening bent pins in a multi-pin connector on a printed wiring assembly.

2. Discussion

Modern electronic devices commonly employ the use of multi-pin connectors to make the necessary mechanical and electrical interconnections among constituent electronic components. For example, in the field of computer systems, a disc drive is generally provided with a plurality of multi-pin connectors to which external ribbon cables are attached to make the necessary communication and control connections between the electronic components of the disc drive and a host computer.

During the manufacturing of such electronic devices, it is common to provide the electronic components for the devices on printed wiring assemblies (PWAs). PWAs are generally provided with multi-pin connectors as required to enable electrical access to and from the electronics located on the PWAs.

Modern PWAs are generally complex and facilitate greater amounts of electronic functionality with the continuing trend of electronic component integration. As a result, modern multi-pin connectors are becoming increasingly smaller in size and, at the same time, facilitating a larger number of individual electrical connection paths to accommodate the increased functionality of the PWAs. Thus, the correct alignment of the pins in multi-pin connectors is becoming increasingly important, as the dimensions of the pins as well as the distance to adjacent pins continue to decrease.

As a result of the increased complexity of modern multi-pin connectors, automated placement and soldering techniques are typically employed in high volume manufacturing processes to install the connectors onto PWAs; particularly, manual installation of such connectors using hand-soldering techniques is inefficient and can degrade the reliability of the PWAs.

A problem that is well known in the art of electronic device manufacturing is the occurrence of misaligned (bent) pins in an individual connector. Particularly, a pin may be bent as a result of the mating of a connector during manufacturing assembly or test processes. Additionally, a connector may be provided from the connector supplier with a bent pin, which is not discovered until the connector is already installed on the PWA. During manufacturing, attempts to repair such a damaged connector can involve efforts to straighten the pin to a correct alignment within the connector (using, for example, a pair of needle nosed pliers) or through efforts to replace the entire connector. Alternatively, the PWA may be scrapped altogether when a determination is reached that such action is more cost effective than repairing the damaged connector, based upon the resources required to replace the connector and the associated risk of causing damage to the PWA.

Generally, tools for repairing electrical contacts are known in the art; see, for example, U.S. Pat. No. 3,041,649 issued Jul. 3, 1962 to Isenhour, which discloses a hand tool for adjustment and repair of electrical contacts in socket connectors, such as used in vacuum tubes. However, based upon the complexity of modern multi-pin connectors and the attendant handling requirements of modern integrated circuits and devices (including highly ESD sensitive magnetoresistive heads now used in disc drives), there is a continuing need for improvements in tools useful for repairing damaged connectors.

SUMMARY OF THE INVENTION

The present invention comprises an improved pin straightening tool for aligning a pin in a multi-pin connector.

Particularly, the pin straightening tool includes an electrically conductive handle having a beveled end and a hollow recess extending longitudinally into the beveled end. An alignment tip is connected to the end of the handle and used to align the pin.

The alignment tip includes a shaft which is inserted into the recess of the beveled end of the handle and a tube which extends longitudinally from the shaft and away from the handle. The tube has a hollow recess having an inner diameter sized for receipt of the pin and the outer diameter of the tube is sized for placement of the tube between adjacent pins in the multi-pin connector.

Preferably, engagement means is provided between the alignment tip and the handle so that the alignment tip can be engaged and subsequently removed from the handle. This facilitates the use of multiple alignment tips for different sized pins in different connectors. A hollow recess within the handle facilitates storage of these additional alignment tips. Additionally, a pocket clip is attached to the handle for clipping the pin straightening tool when the pin straightening tool is not in use.

An object of the present invention is to facilitate the alignment of pins in a multi-pin connector.

Another object is to protect sensitive electronic components associated with the connector from damage due to electrostatic discharge.

Still another object is to facilitate the alignment of pins of various sizes and configurations.

Other objects, advantages and features of the present invention will be apparent from the following description when read in conjunction with the drawings and appended claims.

DETAILED DESCRIPTION OF THE PREFERRED EMBODIMENT

Figure 1:
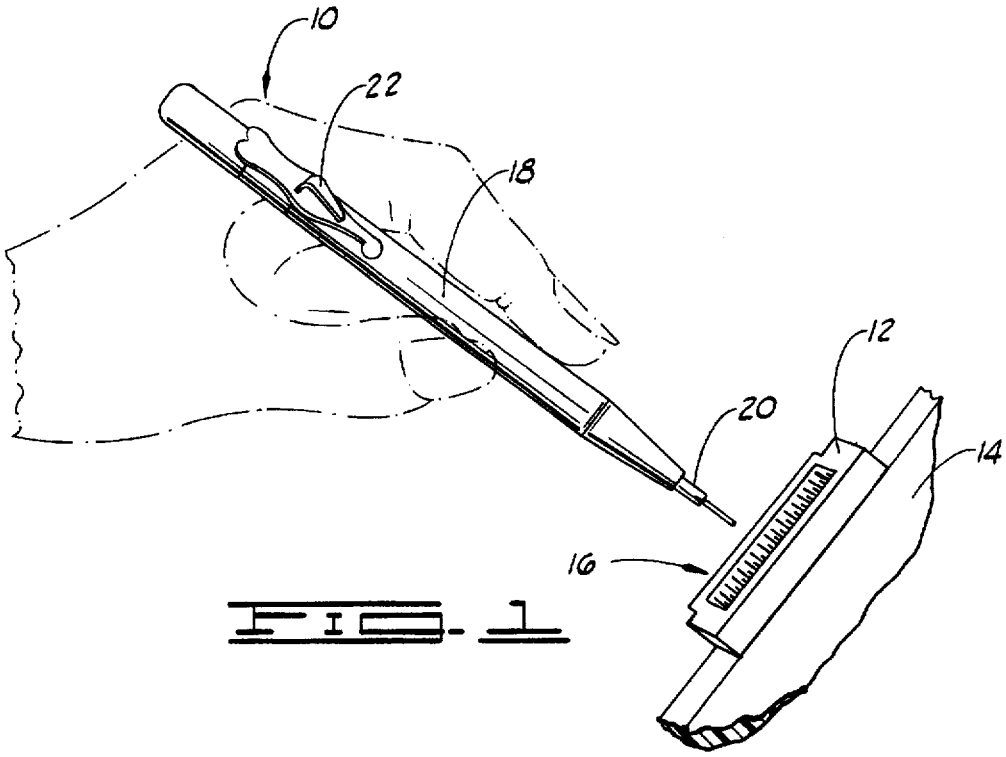
FIG. 1 is an isometric view of the pin straightening tool of the present invention, in conjunction with a multi-pin connector.

Turning now to the drawings and more particularly to FIG. 1, shown therein is an isometric view of a pin straightening tool 10 constructed in accordance with the preferred embodiment of the present invention, in conjunction with a multi-pin connector 12 installed on a printed wiring assembly (PWA) 14. The pin straightening tool 10 comprises a hand-held device useful for straightening bent pins 16 in the multi-pin connector 12.

The pin straightening tool 10 includes a handle 18 shaped as shown in FIG. 1 for manipulation by a user of an alignment tip 20 over selected pins 16. Also shown in FIG. 1 is a clip 22, provided to secure the pin straightening tool 10, for example to a pocket of the user, when the pin straightening tool 10 is not in use.

Figure 2:
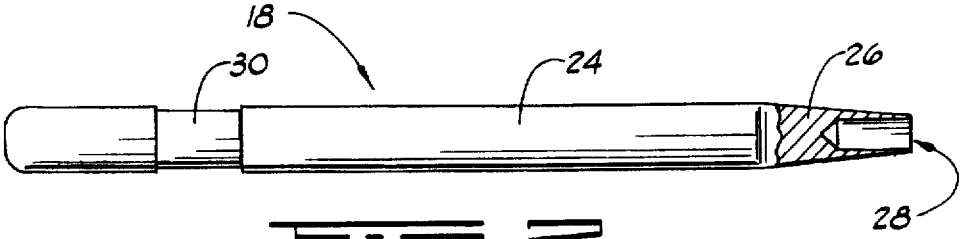
FIG. 2 is an elevational view of the handle of the pin straightening tool of FIG. 1.

FIG. 2 provides an elevational view of the handle 18 of the pin straightening tool 10 of FIG. 1. More particularly, the handle 18 comprises a generally cylindrical body portion 24 and a beveled portion 26 having a recess 28 for receipt of the alignment tip 20 (not shown in FIG. 2.).

The beveled portion 26 is shown in a cross-sectioned fashion to illustrate the relative configuration of the beveled portion 26 and the recess 28. The body portion 24 further includes a groove 30 for engagement with the clip 22 of FIG. 1. The handle 18 is fabricated from an electrically conductive material, preferably aluminum.

Figure 3:
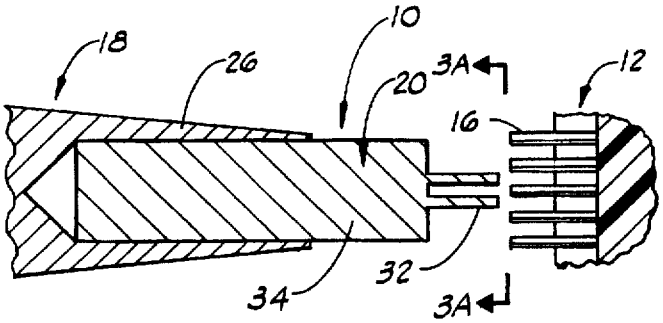
FIG. 3 is a cross-sectional view of the handle and alignment tip of the pin straightening tool of FIG. 1, in conjunction with a portion of the multi-pin connector of FIG. 1.

FIG. 3 provides a cross-sectional view of the handle 18 and alignment tip 20 of the pin straightening tool 10 of FIG. 1, in conjunction with a portion of the multi-pin connector 12 of FIG. 1. The alignment tip 20 comprises a tube 32 extending longitudinally as shown from a shaft 34 of the alignment tip 20. The tube 32 is sized with an inner diameter to fit over a selected pin 16 of the multi-pin connector 12 and an outer diameter to fit between adjacent pins 16. The length of the tube 32 allows the selected pin 16 to be fully inserted into the tube 32 and adjusted by the application of force to the handle 18 by the user.

Figure 3A:
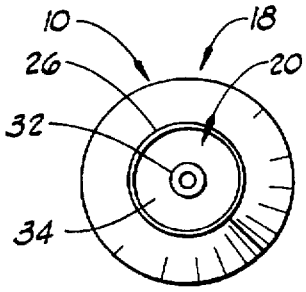
FIG. 3*a* is an end view taken along the line 3*a*—3*a* of FIG. 3.

The shaft 34 of the alignment tip 20 is inserted into the recess 28 of the beveled portion 26 as shown, securing the alignment tip 20 to the handle 18. Various alternative configurations and methodologies for mating the alignment tip 20 and the handle 18 will be discussed below, but FIG. 3 illustrates a press-fit between these components, so that the alignment tip 20 in FIG. 3 is permanently mated with the handle 18. FIG. 3*a* provides an end view of the pin straightening tool 10 of FIG. 3, taken along the line 3*a*—3*a* shown therein.

Figure 4:
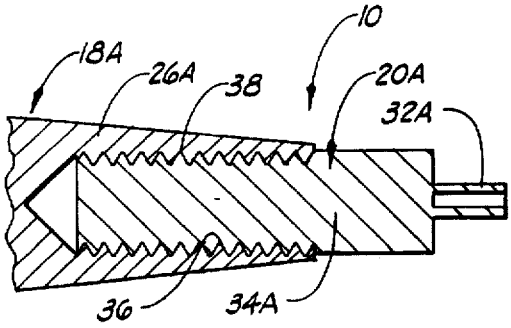
FIG. 4 shows an alternative threaded alignment tip for the pin straightening tool of FIG. 1.

FIG. 4 provides an alternative embodiment for the pin straightening tool 10 of FIG. 1; particularly, FIG. 4 shows threads 36 on a shaft 34A of a removable alignment tip 20A which mate with corresponding threads 38 of a beveled portion 26A of a handle 18A (for purposes of clarity, the reference numbers used to identify the items in FIGS. 1–3 have been augmented in FIG. 4 with the letter designation "A" to identify corresponding elements between these sets of figures). Thus, in FIG. 4, the alignment tip 20A is mated with the handle 18A by screwing the alignment tip 20A into the handle 18A. This makes the alignment tip 20A removable from the handle 18A, facilitating the replacement of the alignment tip 20A in the event that the alignment tip 20A is damaged. Additionally, the ability to remove the alignment tip 20A from the handle 18A facilitates the use of multiple alignment tips 20A having different configurations, including different sized tubes 32A to accommodate a variety of sizes of pins 16 in the multi-pin connectors 12.

Figure 5:
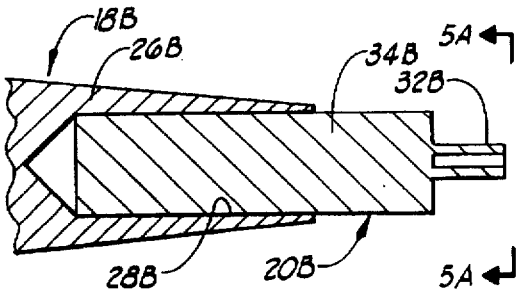
FIG. 5 shows an alternative grooved alignment tip for the pin straightening tool of FIG. 1.
Figure 5A:
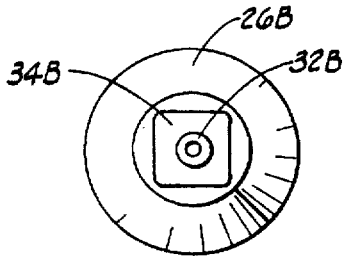
FIG. 5*a* is an end view taken along the line 5*a*—5*a* of FIG. 5.

Referring now to FIG. 5, shown therein is another embodiment for the pin straightening tool 10 of FIG. 1. Particularly, FIG. 5 provides an alignment tip 20B having a grooved shaft 34B which engages with a corresponding beveled portion 26B of a handle 18B as shown. As illustrated in FIG. 5*a*, which provides an end view along line 5*a*—5*a* in FIG. 5, the grooved shaft 34B is generally rectangular in shape and has four grooves, or radiused corners. Corresponding recess 28B in the beveled portion 26, into which the grooved shaft 34B is inserted, can also be provided with the same shape as the grooved shaft 34B (as illustrated in FIG. 5*a*). Alternatively, the recess 28B can be provided with a round shape so that the four corners of the grooved shaft 34B contact the sides of the recess 28B. It will be recognized that the configuration of the grooved shaft 34B allows the insertion force required to insert and subsequently retain the alignment tip 20B to be precisely controlled. As with the alignment tip 20A of FIG. 3, the alignment tip 20B of FIG. 4 is removable from the handle 18B.

Figure 6:
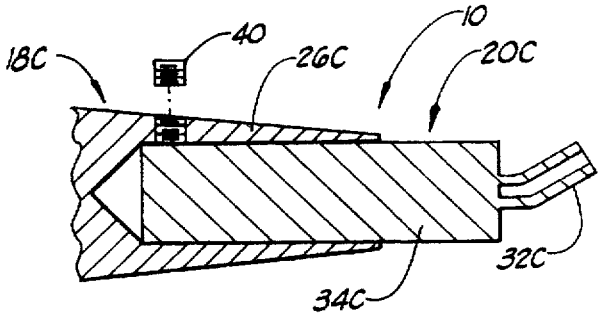
FIG. 6 shows an alternative set screw arrangement for the alignment tip for the pin straightening tool of FIG. 1.

FIG. 6 provides another embodiment for the pin straightening tool 10 of FIG. 1. Shown in FIG. 6 is an alignment tip 20C which is secured by a set screw 40; more particularly, the set screw 40 screws into a beveled portion 26C of a handle 18C so that the set screw 40 contacts a shaft 34C of the alignment tip 20C. Thus, it is contemplated in FIG. 6 that the alignment tip 20C is inserted into the beveled portion 26C and then the set screw 40 is screwed into the beveled portion 26C until sufficient retaining force upon the shaft 34C is achieved.

Additionally, the alignment tip 20C in FIG. 6 is shown to include an angled tube 32C, which is radiused as shown. The angled tip 32C is longer than the previously described straight tubes 32, 32A and 32B. More particularly, the angled tip 32C includes a radiused portion (not separately designated) adjacent the shaft 34C and a straight portion (not separately designated) having sufficient length to accommodate the full length of the pins 16 (shown in FIG. 3).

Figure 7:
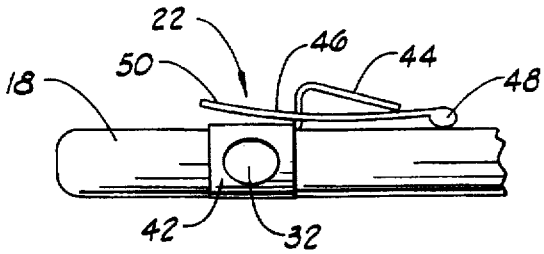
FIG. 7 illustrates the clip of the pin straightening tool of FIG. 1.

Referring now to FIG. 7, shown therein is an elevational view of the clip 22 of FIG. 1, which, as provided hereinabove, facilitates the storage of the pin straightening tool 10 in a pocket or other suitable location when not in use. More particularly, the clip 22 comprises a c-shaped attachment bracket 42 which engages with the groove 30 of the handle 18, as shown in FIG. 2. A spring arm 44 extends from the attachment bracket 42, exerting a force upon a clip arm 46 adjacent a contact nub 48 of the clip arm 46. The spring arm 44 extends through a hole (not designated) in the clip arm 46, securing the clip arm 46 relative to the handle 18 and allowing pivotable movement of the clip arm 46 relative to the handle 18. Thus, the pin straightening tool 10 can be clipped to a surface by depressing an extension arm 50 of the clip arm 46, causing the clip arm 46 to pivot so that the pin straightening tool 10 can be clipped to an appropriate surface by way of the contact nub 48.

Figure 8:
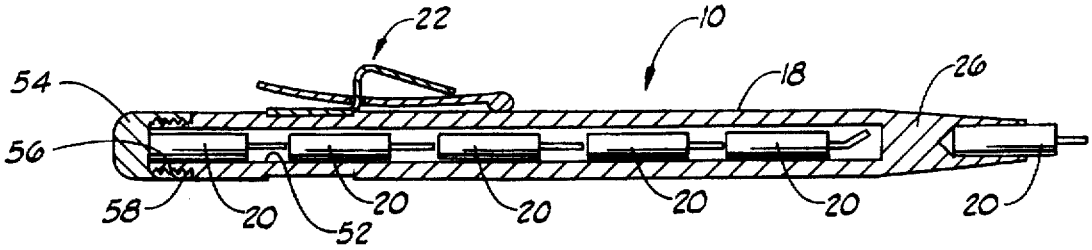
FIG. 8 is a cross-sectional view of the pin straightening tool of FIG. 1, showing storage of a plurality of different sized alignment tips within a hollow recess of the pin straightening tool of FIG. 1.

Referring now to FIG. 8, shown therein is a cross-sectional view of the pin straightening tool 10 of FIG. 1, showing the storage of a plurality of different sized alignment tips 20 within a hollow recess 52 of the pin straightening tool 10. Particularly, the handle 18 is provided with the hollow recess 52 which is sized accordingly to allow the alignment tips 20 to be stored within the hollow recess 52 for selective use with a variety of different sized pins 16 in a plurality of different connectors 12. The handle 18 is provided with a cap 54, which includes threads 56 which mate with corresponding threads 58 of the handle 18. It is contemplated that the alignment tips 20 of FIG. 8 can be provided with visual indications, such as different colors, in order to indicate the corresponding sizes of the pins 16 accommodated by the alignment tips 20.

As provided hereinabove, the handle 18 is contemplated as being fabricated from aluminum, which is electrically conductive and serves to provide electrostatic discharge (ESD) protection to the electronic components tied to the pins 16 of the connectors 12. Particularly, modern electronic components are increasingly susceptible to damage from ESD, so that the PWAs 14 are typically handled at ESD safe workstations by electrically grounded personnel. Thus, electrical conductivity is an important feature of the pin straightening tool 10.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. A pin straightening tool for aligning a pin in a multi-pin connector, the multi-pin connector having a plurality of uniformity and closely spaced pins, the pin straightening tool comprising:

an electrically conductive handle having a beveled end and a hollow recess extending longitudinally into the beveled end;

an alignment tip connected to the end of the handle, the alignment tip, comprising:

a shaft inserted into the recess of the beveled end of the handle; and a tube extending longitudinally from the shaft and away from the handle, the tube having a hollow recess, the hollow recess of the tube having an inner diameter sized for receipt of the pin, and an outer diameter of the tube sized for placement of the tube between adjacent pins in the multi-pin connector; and engagement means for engaging the alignment tip with the handle, the engagement means allowing the alignment tip to be engaged and subsequently removed from the handle, wherein the handle further comprises a second hollow recess for storage of a second alignment tip having an inner diameter different than the inner diameter of the alignment tip.

2. The pin straightening tool of claim 1, wherein the engagement means comprises threads provided on the shaft of the alignment tube and corresponding threads provided in the recess of the beveled end of the handle, wherein the alignment tip is screwed into the handle.

3. The pin straightening tool of claim 1, further comprising a clip attached to the handle for clipping the pin straightening tool to a surface when the pin straightening tool is not in use.

4. The pin straightening tool of claim 1, further comprising a cap for enclosing the second hollow recess of the handle to contain the second alignment tip within the hollow recess of the handle.

5. The pin straightening tool of claim 1, wherein the tube of the alignment tip is angled so that when the pin is received by the tube, the pin is aligned along an axis which is skewed with respect to the handle.

* * * * *